US005167535A

United States Patent [19]

Kovacik et al.

[11] Patent Number: 5,167,535

[45] Date of Patent: Dec. 1, 1992

[54] FEMALE ELECTRICAL PLUG WITH OVERLOAD PROTECTION

[75] Inventors: James D. Kovacik, Brecksville; Thomas J. Blanch, Hudson; Paul S. Blanch, Valley View, all of Ohio

[73] Assignee: Alert Safety Lite Products Co., Inc., Bedford Heights, Ohio

[21] Appl. No.: 871,579

[22] Filed: Apr. 20, 1992

Related U.S. Application Data

[63] Continuation of Ser. No. 655,760, Feb. 14, 1991, abandoned.

[51] Int. Cl.[5] ..... H01R 13/713

[52] U.S. Cl. ..... 439/620; 200/51 R

[58] Field of Search ..... 200/51 R; 337/91, 113; 439/620

[56] References Cited

U.S. PATENT DOCUMENTS

| | | | |
|---|---|---|---|
| 1,641,002 | 8/1927 | Kaplan | 337/113 |
| 2,399,406 | 4/1946 | Toth | 337/91 |
| 2,783,329 | 2/1957 | Jackson | 337/113 |
| 2,913,552 | 11/1959 | Roberts | 337/113 |
| 3,539,961 | 11/1970 | Worthington | 337/192 |
| 4,307,925 | 12/1981 | Drew | 439/622 |
| 4,418,978 | 12/1983 | Shamir | 439/409 |
| 4,420,214 | 12/1983 | Wu | 439/622 |
| 4,480,891 | 11/1984 | Wu | 439/622 |
| 4,573,031 | 2/1986 | Krasser | 337/68 |
| 4,575,704 | 3/1986 | Pezold | 337/197 |
| 4,592,613 | 6/1986 | Tong | 439/622 |
| 4,661,892 | 4/1987 | Reed, Jr. | 362/226 |
| 4,667,175 | 5/1987 | Sell | 337/68 |
| 4,717,350 | 1/1988 | Lax | 439/620 |
| 4,758,184 | 7/1988 | Call | 439/622 |
| 4,869,675 | 9/1989 | Ogawa | 439/374 |

FOREIGN PATENT DOCUMENTS

| | | | |
|---|---|---|---|
| 40729 | 1/1925 | Norway | 337/113 |

*Primary Examiner*—Gary F. Paumen

*Attorney, Agent, or Firm*—William J. Clemens

[57] ABSTRACT

A female electrical plug includes a pair of female terminals for engaging prongs of a male electrical plug, a female ground terminal, and a circuit breaker providing a path for electrical current and being responsive to electrical current flow in excess of a predetermined amount for opening the path and preventing the current flow, the circuit breaker having a reset button manually actuatable for closing the path. The plug also has a first conductor connected in series with the circuit breaker to one of the female terminals, a second conductor connected to another one of the female terminals and a third conductor connected to the female ground terminal. A body formed of an insulating material encapsulates the female terminals, the female ground terminal, the conductors and the circuit breaker. The body has a generally planar front surface with a pair of prong shaped apertures formed therein providing access to the female terminals and a ground prong shaped aperture providing access to said female ground terminal. Another aperture is formed in a side surface of the body through which the reset button extends and a pair of guard walls are formed on the side surface on opposite sides of the reset button for protecting the reset button from accidental actuation. An additional two sets of pairs of female electrical terminals and a female ground terminal can be encapsulated in the body on opposite sides of the two female terminals and connected in parallel accommodate three male plugs.

13 Claims, 2 Drawing Sheets

FEMALE ELECTRICAL PLUG WITH OVERLOAD PROTECTION

This application is a continuation of U.S. patent application Ser. No. 07/655,760, filed Feb. 14, 1991 and now abandoned.

BACKGROUND OF THE INVENTION

The present invention relates generally to an electric plug for an extension cord and, in particular, to a circuit breaker protected female electrical plug molded onto the end of a power cord.

Generally, when electrical appliances are connected to a typical wall receptacle, there is no overload protection in the power line against surges of electric current which might seriously damage the electrical appliances. Typically, the only safety devices provided are circuit interrupters which are adapted to either open or burn out when a current overload is present for a predetermined time.

Conventionally, the circuit interrupters are located centrally, particularly in a domestic establishment, with at least one circuit interrupter having a capacity of approximately 15 or 20 amperes governing each circuit. The amperage capacity of the circuit interrupter may be excessive and afford little protection for an individual electrical device. For example, a load with a critical power rating below such a capacity may be damaged or may create damage if its rating is exceeded for an appreciable length of time. The circuit interrupters fail to adequately protect appliances because a current overload which might be less than that required to open or burn out the interrupter, and still great enough to cause damage, can flow through the circuit interrupter unimpeded. Typically such current overloads result from voltage surges caused by lightning striking the structure in which these appliances are housed, or by striking an exposed power line. For such loads which are not individually fused, adequate protection may be obtained by the use of an electric cord equipped, as contemplated by the present invention, with its own individual circuit interrupter.

It should be understood that the term "circuit interrupter" is used to designate any device which provides a conductive link in an electrical circuit designed to "open" under overload thus interrupting the circuit. While various types of circuit interrupters are available, the type used in the present invention is restorable (or resettable) to the "closed" position thus reconstituting the circuit when the overload has been removed or cured. This type of circuit interrupter is generally identified as a circuit breaker whereas the common nonresettable type is known as a fuse which burns out or "blows" under overload.

The use of power cables which are "fused" as distinguished from those equipped with circuit breakers is not new; there being much prior art relating thereto. These suffer, however, from one major disadvantage, amongst others, in that the lack of a replacement fuse or the proper repair materials in an emergency may prompt someone to resort to evasive means for restoring a power cable to functionality, thereby, depriving its associated load of essential protection more or less permanently. This is because it is a common human tendency to leave an emergency repair as a permanent repair, thereby, totally defeating the intent and primary function of the fused power cable.

A variety of devices are known for isolating electrical appliances and the like from electrical currents in excess of a predetermined value. U.S. Pat. No. 4,307,925 discloses a male plug connector encapsulating a circuit breaker. In one embodiment, the reset button for the circuit breaker is located in the same surface as the terminals of the plug. In another embodiment, FIG. 5, the terminals extend radially outwardly from the longitudinal axis of the plug and the circuit breaker reset button is located in the surface from which the terminals would normally extend U.S. Pat. No. 3,539,961 discloses an isolator having a male plug and a female receptacle connected together by a fusible link for insertion between an electrical appliance power line and a wall receptacle.

SUMMARY OF THE INVENTION

The present invention concerns a female electric plug typically attached to one end of an electrical cord assembly having a male electrical plug attached to the opposite end for engagement with an electrical outlet. The female plug is selectively engagable with a male electrical plug connected to an electrical device for supplying electrical current from the outlet to the electrical device. The plug includes a pair of female terminals and a female ground terminal for engaging the prongs of the male electrical plug, a circuit breaker providing a path for electrical current and being responsive to electrical current flow in excess of a predetermined amount for opening the path and preventing the current flow, the circuit breaker having a reset button manually actuatable for closing the path, a first conductor connected in series with the circuit breaker to one of the female terminals, a second conductor connected to another one of the female terminals, and a third conductor connected to the female ground terminal.

A body formed of an electrical insulating material encapsulates the female terminals, the female ground terminal, the first, second and third conductors and the circuit breaker. The body has a generally planar front surface with a pair of prong shaped apertures formed therein providing access to the female terminals, a ground prong shaped aperture formed in the front surface providing access to the female ground terminal and another aperture formed in a side surface of the body through which the reset button extends. A pair of guard walls are formed on the side surface of the body, the walls extending outwardly from the side surface on opposite sides of the reset button for protecting the reset button from accidental actuation.

In an alternate embodiment, two additional sets of a pair of female electrical terminals and a female ground terminal are encapsulated in the body on opposite sides of the first two female terminals. Corresponding terminals of each set are connected in parallel and additional prong shaped apertures are formed in the front surface of the body providing access to the terminals for engaging up to three male plugs.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
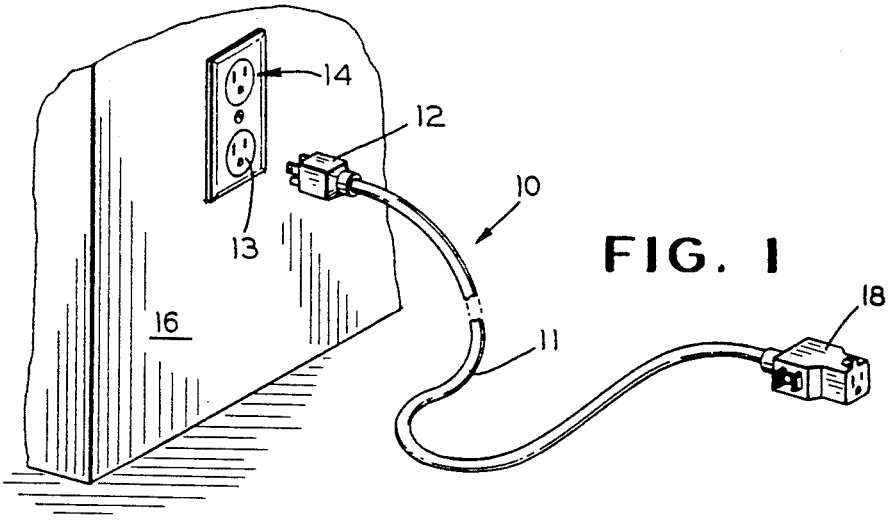
FIG. 1 is a perspective view of an electrical cord assembly having a female electrical plug embodying the features of the present invention.
Figure 2:
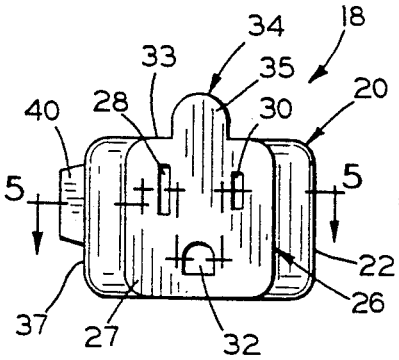
FIG. 2 is front elevational view of the plug shown in the FIG. 1.

Referring to the FIG. 1, there is illustrated an electric cord assembly 10 formed from a three conductor cable 11 having a three prong male plug 12 attached at one end for insertion into an electrical outlet 13 of a conventional grounded wall socket 14 mounted in a wall 16. At an opposite end of the cable 11 is attached a female plug 18 in accordance with the present invention.

The plug 18 has a (one-piece) body 20 extending along a longitudinal axis 21 (FIG. 3) and formed of an electrically insulative material. The body 20 has a generally rectangular cross section with rounded edges. As illustrated in greater detail in the FIGS. 3-5, the body 20 of the plug 18 has an enlarged central portion 22 connected between a first or rear end portion 24 and a second or front end portion 26. The first end portion 24 has a generally cylindrical cross-section and is adapted to receive and encapsulate the adjacent end portion of the electrical cable 11. The cable 11 extends in the direction of the longitudinal axis 21 of the body 20 and exits a rear surface 25 of the end portion 24.

The second end portion 26 is generally square in cross section and has a generally planar front surface 27. The surface 27 has three apertures formed therein for receiving the prongs of a typical male electrical plug. An aperture 28 and an aperture 30 are formed as horizontally spaced, vertically extending slots with the aperture 28 at the left being longer as is typical of a polarized plug. An aperture 32 is semi-circular and positioned between and below the apertures 28 and 30 for receiving a ground prong of the male plug.

An upper surface 33 of the end portion 26 has a projection 34 formed thereon. The projection 34 is centered between the apertures 28 and 30 and is generally semi-circular in cross section with a planar front surface 35 coextensive with the front surface 27.

A reset button 36 extends outwardly from a left side surface 37 of the central portion 22. The reset button 36 is positioned between a pair of upstanding guard walls 38 and 40 which extend outwardly from the surface 37 in parallel planes perpendicular to the longitudinal axis 21 of the body 20. As shown in the FIG. 5, the reset button 36 is connected to a circuit breaker 42 encapsulated within the central portion 22. The guard walls 38 and 40 shield the button 36 to prevent accidental actuation of the button and the circuit breaker 42.

Figure 5:
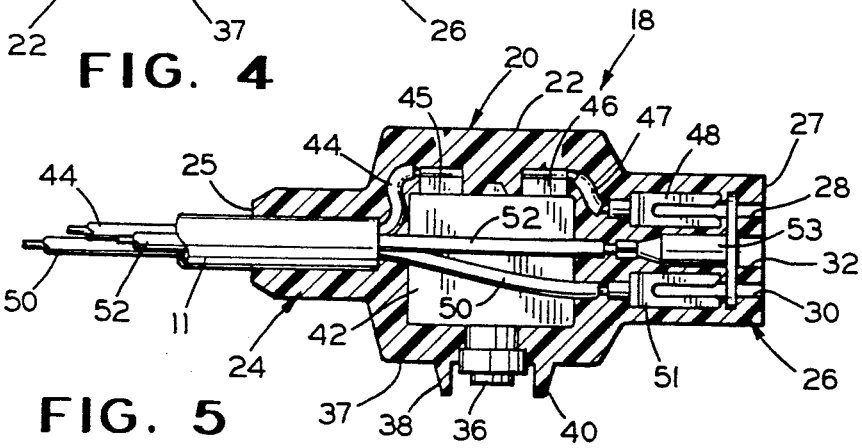
FIG. 5 is a sectional view of the plug shown in the FIG. 2 taken along the line 5—5.

Referring to the FIG. 5, the circuit breaker 42 is connected in series in a conductor 44 electrically connected to a female terminal 45. The terminal 45 engages a male terminal or prong (not shown) of the circuit breaker 44 for current flow into the circuit breaker. A similar male terminal or prong (not shown) on the circuit breaker 42 is engaged by another female terminal 46 for current flow from the circuit breaker. The electrical circuit of the conductor 44 is extended to the aperture 28 by a conductor 47 connected between the terminal 46 and a female terminal 48 positioned in the aperture 28 and adapted to receive a larger prong of a male electrical plug.

The cable 11 includes the conductor 44 and a return conductor 50. The conductor 50 is connected directly to a female terminal 51 positioned in the aperture 30 and adapted to receive a smaller prong of a male electrical plug. The cable 11 also includes a ground conductor 52 which is connected directly to a female terminal 53 positioned in the aperture 32 and adapted to receive a ground prong of a male electrical plug.

The circuit breaker 42 functions to provide overcurrent protection to any electrical device which is to be provided with power from the electrical outlet 13. The circuit breaker 42 is set at a predetermined amperage rating to interrupt the electric current flow through the conductor 44 when the current flow therein exceeds the predetermined amperage rating for any reason. The current rating of the circuit breaker 42 is selected to correspond to the amperage rating of the electrical devices to be protected which rating is lower than the current rating of the electrical circuit connected to the outlet 13.

Figure 3:
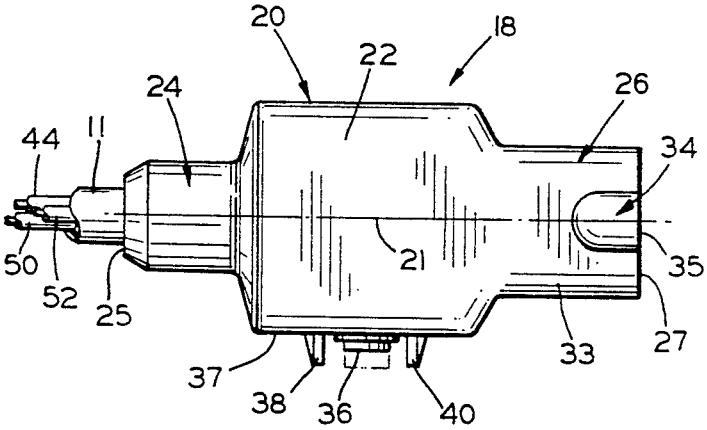
FIG. 3 is a top plan view of the plug shown in the FIG. 2.
Figure 4:
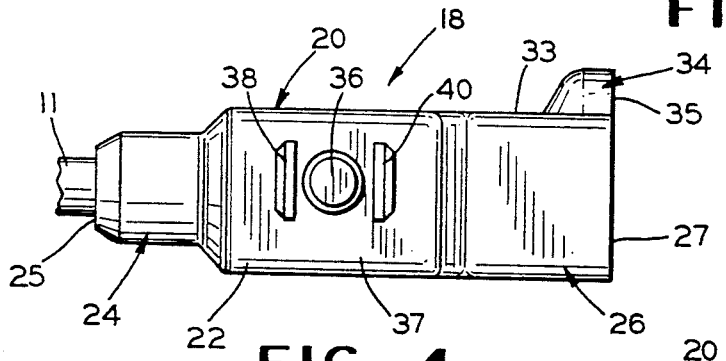
FIG. 4 is a left side elevational view of the plug shown in the FIG. 2.

When the circuit breaker 42 is actuated to open the current path in the conductor 44, the reset button 36 is extended outwardly from the position shown in solid line in the FIG. 3 to the position shown in phantom line. Thus, the reset button 36 serves to indicate that the amperage rating of the cord assembly 10 has been exceeded and the circuit breaker 42 has been actuated. Typically, the circuit breaker 42 includes a thermally responsive element (not shown) which is heated by current flow and opens the circuit when excess current flow heats the element above a predetermined temperature. Upon actuation, the circuit breaker 42 cannot be reset until the thermally responsive element has cooled for a period even if the reset button 36 is urged inwardly. When the element has cooled sufficiently, the button 36 can be positively locked in the position shown in solid line and current will flow.

Often, it is desirable to prevent the accidental turning on or off of an electrical device. The guard walls 38 and 40 protect against accidental actuation of the button 36 when it is in the solid line position such that a connected electrical device is not turned off. The walls also protect against accidental actuation of the button 36 when it is in the phantom line position such that a connected electrical device is not turned on before the cause of the current overload is corrected.

Figure 6:
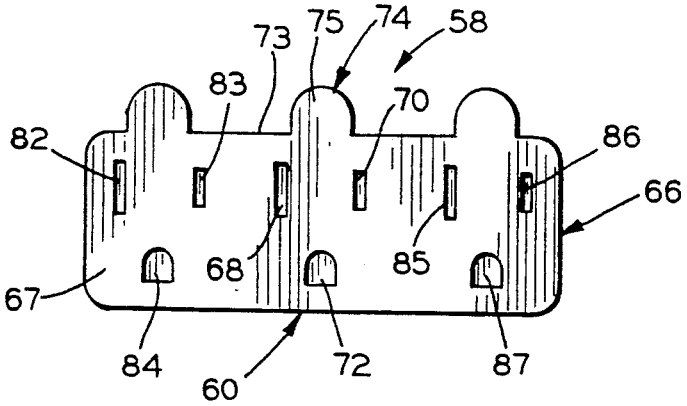
FIG. 6 is front elevational view of an alternate embodiment of the electrical plug in accordance with the present invention.
Figure 7:
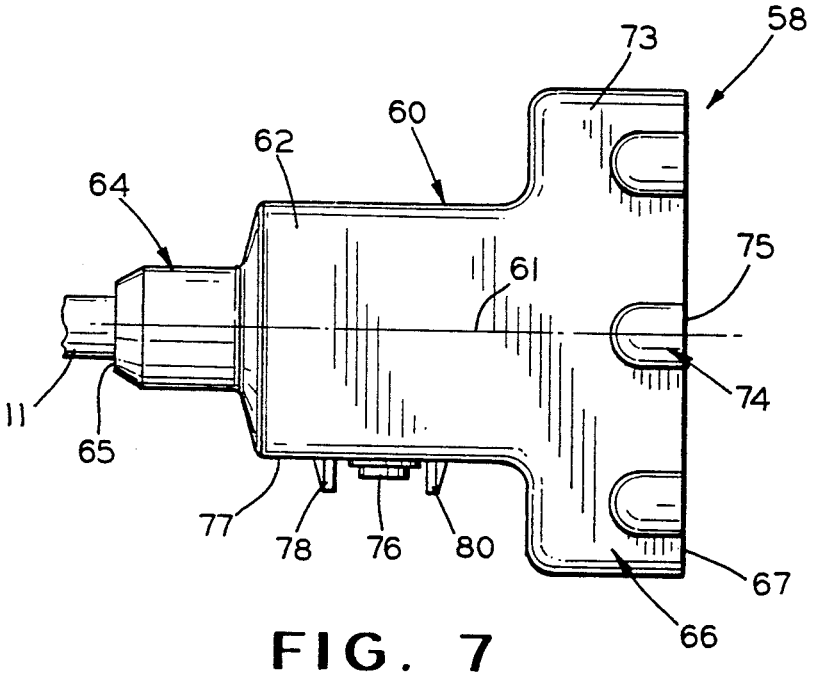
FIG. 7 is a top plan view of the plug shown in the FIG. 6.
Figure 8:
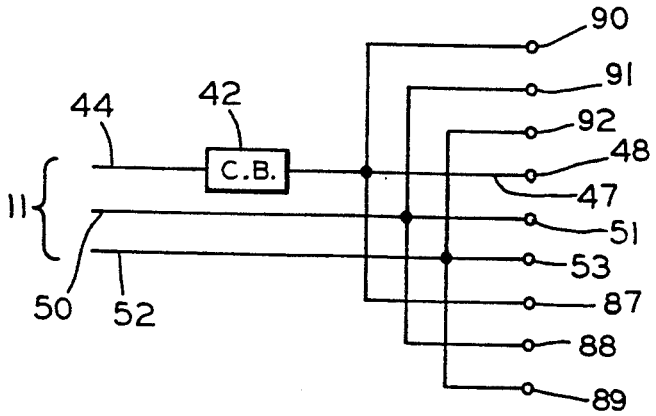
FIG. 8 is an electrical schematic of the plug shown in the FIG. 6.

An alternate embodiment of the present invention is shown in the FIGS. 6-8. A female plug 58 has a (one-piece) body 60 extending along a longitudinal axis 61 (FIG. 7) and formed of an electrically insulating material. The body 60 has a generally rectangular cross section with rounded edges and an enlarged central portion 62 connected between a first or rear end portion 64 and a second or front end portion 66. The first end portion 64 has a generally cylindrical cross-section and is adapted to receive and encapsulate the adjacent end portion of the electrical cable 11. The cable 11 extends in the direction of the longitudinal axis 61 of the body 60 and exits a rear surface 65 of the end portion 64.

The second end portion 66 is generally rectangular in cross section and has a generally planar front surface 67. The end portion 66 is configured as three of the second end portions 26 positioned side-by-side. The surface 67 has three sets of three apertures formed therein for receiving the prongs of a typical male electrical plugs. In the center, an aperture 68 and an aperture 70 are formed as horizontally spaced, vertically extending slots with the aperture 68 at the left being longer as is typical of a polarized plug. An aperture 72 is semi-circular and positioned between and below the apertures 68 and 70 for receiving a ground prong of the male plug.

An upper surface 73 of the end portion 66 has a projection 74 formed thereon. The projection 74 is centered between the apertures 68 and 70 and is generally semi-circular in cross section with a planar front surface 75 coextensive with the front surface 67.

A reset button 76 extends outwardly from a left side surface 77 of the central portion 62. The reset button 76 is positioned between a pair of upstanding guard walls 78 and 80 which extend outwardly from the surface 77 in parallel planes perpendicular to the longitudinal axis 61 of the body 60. The reset button 76 is connected to a circuit breaker (not shown) similar to the circuit breaker 42 and encapsulated within the central portion 62.

At either side of the front surface 67 are provided an additional set of apertures, the set 82, 83 and 84 and the set 85, 86 and 87, for cooperating with the prongs of two male plugs (not shown). As shown in the FIG. 8, the cable 11 includes the conductors 44, 50 and 52 which extend into the body 60 in the same manner as in the plug 18. Provided inside the body 60 are the circuit breaker 42, the conductor 47, and the terminals 48, 51 and 53. Positioned in the apertures 82, 83 and 84 are female terminals 87, 88 and 89 respectively, electrically connected to the terminals 48, 51 and 53 respectively. Positioned in the apertures 85, 86 and 87 are female terminals 90, 91 and 92 respectively, electrically connected to the terminals 48, 51 and 53 respectively. Thus, the three sets of female terminals are connected in parallel and are protected by the circuit breaker 42.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A molded female electrical plug selectively engagable with a male electrical plug connected to an electrical device for supplying electrical current to the electrical device comprising:

at least two female terminals for engaging prongs of a male electrical plug;

a circuit breaker providing a path for electrical current and being responsive to electrical current flow in excess of a predetermined amount for opening said path and preventing the current flow, said circuit breaker having a reset button manually actuatable for closing said path;

a first electrical conductor having one end connected in series with said circuit breaker to one of said female terminals;

a second electrical conductor having one end connected to another one of said female terminals; and a one-piece body formed of an insulating material and molded about and encapsulating said female terminals, said one ends of said first and second electrical conductors and said circuit breaker, said body having a generally planar front surface with a pair of prong shaped apertures formed therein providing access to said female terminals and another aperture formed in a side surface of said body through which said reset button extends for manual actuation.

2. The electrical plug according to claim 1 including a female ground terminal encapsulated in said body, a ground prong shaped aperture formed in said front surface of said body providing access to said ground terminal, and a third conductor having one end encapsulated in said body and connected to said ground terminal.

3. The electrical plug according to claim 1 including a pair of guard walls formed on said side surface of said body, said walls extending outwardly from said side surface of said body on opposite sides of said rest button whereby said reset button is protected by said guard walls from accidental actuation, said reset button being exposed through gaps between ends of said guard walls.

4. The electrical plug according to claim 1 including at least four of said female terminals encapsulated in said body, one pair of said female terminals being connected in parallel to said first electrical conductor and another pair of said female terminals being connected in parallel to said second electrical conductor, and at least four of said prong shaped apertures formed in said front surface of said body each providing access to an associated one of said female terminals.

5. The electrical plug according to claim 1 including at least six of said female terminals encapsulated in said body, a first three of said female terminals being connected in parallel to said first electrical conductor and a second three of said female terminals being connected in parallel to said second electrical conductor, and at least six of said prong shaped apertures formed in said front surface of said body each providing access to an associated one of said female terminals.

6. The electrical plug according to claim 1 including a male electrical plug having at least two male prongs for engaging female terminals of a female electrical plug, said first and second conductors having opposite ends connected to associated ones of said male prongs, said female electrical plug and said male electrical plug forming a power cord.

7. A female electrical plug selectively engagable with a male electrical plug connected to an electrical device for supplying electrical current to the electrical device comprising:

at least two female terminals for engaging prongs of a male electrical plug;

a circuit breaker providing a path for electrical current and being responsive to electrical current flow in excess of a predetermined amount for opening said path and preventing the current flow, said circuit breaker having a reset button manually actuatable for closing said path;

a first electrical conductor connected in series with said circuit breaker to one of said female terminals;

a second electrical conductor connected to another one of said female terminals;

a one-piece body formed of an insulating material encapsulating said female terminals, said first and second electrical conductors and said circuit breaker, said body having a generally planar front surface with a pair of prong shaped apertures formed therein providing access to said female terminals and another aperture formed in a side surface of said body through which said reset button extends; and a pair of guard walls formed on said side surface of said body, said walls extending outwardly from said side surface of said body on opposite sides of said reset button whereby said reset button is protected by said side walls from accidental damage, said walls being spaced apart to expose said reset button through gaps between ends of said walls for manual actuation.

8. The electrical plug according to claim 7 including a female ground terminal encapsulated in said body, a ground prong shaped aperture formed in said front surface of said body providing access to said ground terminal, and a third electrical conductor encapsulated in said body and having one end connected to said ground terminal.

9. A female electrical plug connected to a male electrical plug and selectively engagable with another male electrical plug connected to an electrical device for supplying electrical current to the electrical device comprising:

a pair of female terminals for engaging prongs of a male electrical plug;

a female ground terminal;

a circuit breaker providing a path for electrical current and being responsive to electrical current flow in excess of a predetermined amount for opening said path and preventing the current flow, said circuit breaker having a reset button manually actuatable for closing said path;

a first electrical conductor having one end connected in series with said circuit breaker to one of said female terminals;

a second electrical conductor having one end connected to another one of said female terminals;

a third electrical conductor having one end connected to said female ground terminal;

a one-piece female plug body molded of an insulating material encapsulating said female terminals, said female ground terminal, said one end of each of said first, second and third electrical conductors and said circuit breaker, said female plug body having a generally planar front surface with a pair of prong shaped apertures formed therein providing access to said female terminals, a ground prong shaped aperture formed in said front surface providing access to said female ground terminal and another aperture formed in a side surface of said female plug body through which said reset button extends; and a pair of male prongs and a male ground prong encapsulated in a molded male plug body, each of said male prongs being connected to an opposite end of an associated one of said first and second electrical conductors and said male ground prong being connected to an opposite end of said third electrical conductor.

10. The electrical plug according to claim 9 including a pair of guard walls formed on said side surface of said female plug body, said guard walls extending outwardly from said side surface of said female plug body on opposite sides of said reset button for protecting said reset button from accidental actuation, said guard walls being spaced apart and extending in generally parallel planes to expose said reset button through gaps between ends of said guard walls for manual actuation.

11. The electrical plug according to claim 9 including two pairs of female electrical terminals encapsulated in said female plug body on opposite dies of said two female terminals, one said terminal of each pair connected in parallel with one of said two female terminals, and two additional pairs of prong shaped apertures formed in said front surface of said female plug body providing access to said two pairs of female terminals.

12. The electrical plug according to claim 11 wherein said female plug body has a generally rectangular cross section central portion encapsulating said circuit breaker, said central portion being connected between a generally circular cross section rear end portion and a front end portion having said front surface, said rear end portion encapsulating an end of an electrical cable including said first, second and third conductors, and said front end portion encapsulating said female terminals and said female ground terminal.

13. The electrical plug according to claim 12 including a projection formed on an upper surface of said front end portion.

* * * * *